US010527284B2

(12) United States Patent
Sobol et al.

(10) Patent No.: US 10,527,284 B2
(45) Date of Patent: Jan. 7, 2020

(54) COMPENSATION ASSEMBLY FOR A DAMPER OF A GAS TURBINE

(71) Applicant: General Electric Technology GmbH, Baden (CH)

(72) Inventors: Karolina Krystyna Sobol, Kusnacht (CH); Christoph Welti, Baden (CH); Urs Benz, Gipf-Oberfrick (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 597 days.

(21) Appl. No.: 14/965,689

(22) Filed: Dec. 10, 2015

(65) Prior Publication Data

US 2016/0169513 A1 Jun. 16, 2016

(30) Foreign Application Priority Data

Dec. 11, 2014 (EP) ..... 14197299

(51) Int. Cl.
*F23R 3/60* (2006.01)
*F23M 20/00* (2014.01)

(52) U.S. Cl.
CPC ..... *F23M 20/005* (2015.01); *F23R 3/60* (2013.01)

(58) Field of Classification Search
CPC ..... F23M 20/005; F23R 3/002; F23R 3/60; F23R 2900/00014
See application file for complete search history.

(56) References Cited

U.S. PATENT DOCUMENTS 2,273,395 A * 2/1942 Couty ..... F16L 27/1008 285/234
4,454,711 A * 6/1984 Ben-Porat ..... F23R 3/10 60/748
5,658,022 A * 8/1997 Shi ..... F16L 27/047 285/148.23
2004/0248053 A1 12/2004 Benz et al.
(Continued)

FOREIGN PATENT DOCUMENTS

EP 2 397 759 A1 12/2011
WO WO 2012/057994 A2 5/2012

OTHER PUBLICATIONS http://anengineersaspect.blogspot.com/2013/08/engineering-quote-of-week-christian.html published Aug. 2013, downloaded Mar. 29, 2019.*
European Search Report for EP 14197299.2 dated May 26, 2015.

*Primary Examiner* — Ted Kim
(74) *Attorney, Agent, or Firm* — Buchanan Ingersoll & Rooney PC

(57) ABSTRACT

The present invention relates to dampers for gas turbines and, for example, to a compensation assembly for a damper of a gas turbine for reducing the pulsations occurring in the combustion chamber. The damper can include a resonator cavity with a neck tube in flow communication with the interior of the combustion chamber, wherein the compensation assembly includes a spherical joint associated to the neck tube and configured to allow relative rotation between the combustion chamber and the resonator cavity, and having a bulb portion disposed around the neck tube and a spherical socket configured to internally host the bulb portion, wherein the spherical socket can have a top collar portion and a bottom collar portion connected to each other.

5 Claims, 10 Drawing Sheets

(56) References Cited

U.S. PATENT DOCUMENTS

| | | | | |
|---|---|---|---|---|
| 2005/0016182 | A1* | 1/2005 | Morenko ..... | F23R 3/50<br>60/800 |
| 2006/0123791 | A1 | 6/2006 | Macquisten et al. | |
| 2012/0102963 | A1 | 5/2012 | Corr et al. | |
| 2014/0345285 | A1 | 1/2014 | Benz et al. | |

* cited by examiner

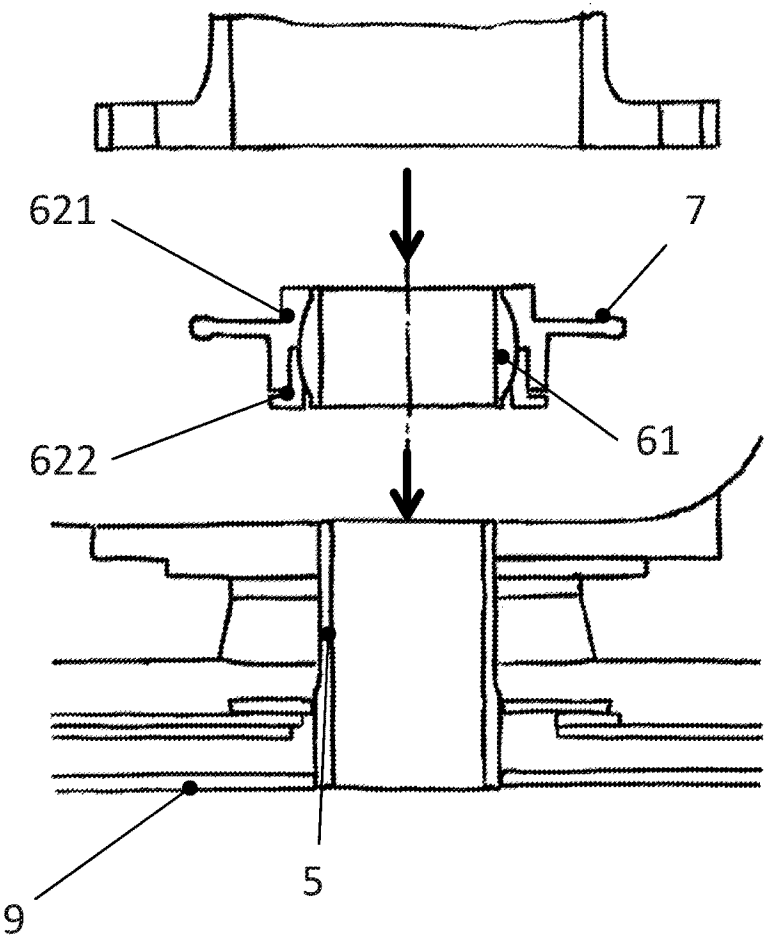
FIG.4
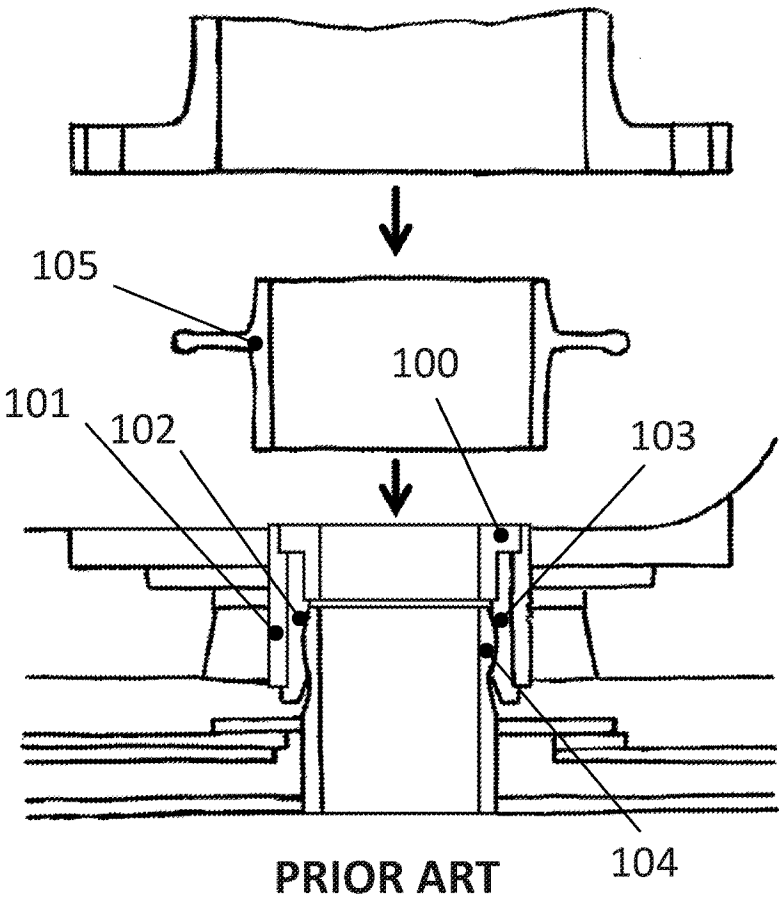

COMPENSATION ASSEMBLY FOR A DAMPER OF A GAS TURBINE

TECHNICAL FIELD

The present invention relates to dampers for gas turbine and, more in particular, to a compensation assembly for a damper of a gas turbine for reducing the pulsations occurring in the combustion chamber.

BACKGROUND

In conventional gas turbines, acoustic oscillation usually occurs in the combustion chamber of the gas turbines during combustion process due to combustion instability and varieties. This acoustic oscillation may evolve into highly pronounced resonance. Such oscillation, which is also known as combustion chamber pulsations, can assume amplitudes and associated pressure fluctuations that subject the combustion chamber itself to severe mechanical loads that my decisively reduce the life of the combustion chamber and, in the worst case, may even lead to destruction of the combustion chamber.

Generally, a type of damper known as Helmholtz damper is utilized to damp the pulsations generated in the combustion chamber of the gas turbine. Currently, one of the main difficulties in utilization of such damper is the fact that the space available for these dampers is limited. One possible approach in addressing such situation is to place the damper on the outer side of the combustion chamber. In practice, the thermal expansion of the different layers composing the combustion chamber prevents directly applying such dampers.

A damping arrangement for reducing resonant vibrations in a combustion chamber of a gas turbine is disclosed in US 2004/0248053 A1, wherein the combustion chamber comprises an outer wall-surface part and an inner wall-surface part facing the combustion chamber, gas tightly encloses an intermediate space, into which cooling air can be fed for purposes of convective cooling of the combustion chamber wall. At least one third wall-surface part is provided, which, with the outer wall-surface part, encloses a gastight volume. The gastight volume is connected gas tightly to the combustion chamber by at least one connecting line. A gasket is welded at an end of the connecting line that is located in the gastight volume, and covers the outer wall surface part to provide gas tightness. With this gasket and connecting lines, the damping arrangement may compensate thermal expansion difference between the outer and inner wall-surface part in one direction.

A combustion chamber suitable for a gas turbine engine is provided in US 2006/0123791 A1, which comprise at least one Helmholtz resonator having a resonator cavity and a resonator neck in flow communication with the chamber interior. The Helmholtz resonator is fixed to an inner casing of the combustion chamber, with the resonator neck penetrating into the interior of the combustion chamber through an opening on the inner wall of the combustion chamber. An annular sealing member is provided around the outer periphery of the neck to provide gas tight seal between the neck and the opening. The neck provides limited relative axial movement of the neck with respect to the combustion chamber so that substantially no load is transferred from the resonator neck to the combustion chamber during engine operation.

A combustor for a gas turbine including at least one resonator is disclosed in WO 2012/057994 A2, which comprises an outer liner and an inner liner. The resonator is coupled to the outer liner. The combustor liner includes a throat extending from the base of the resonator penetrating into the combustion chamber through the inner liner and the outer liner. The combustor liner further includes a grommet assembly that allows for relative thermal expansion between the inner liner and the outer liner proximate the throat in a first direction along the axis of the throat and a second direction perpendicular to the first direction.

A damper for gas turbine is also described in US 2014/345285 which comprises a resonator cavity with an inlet and a neck tube in flow communication with the interior of the combustion chamber and resonator cavity, and a compensation assembly pivotably connected with the neck tube and inserted between the resonator cavity and the combustion chamber to permit relative rotation between the combustion chamber and the resonator cavity.

Even with above mentioned development in the pulsation damping field, there exists a large space to improve the compensation effect in eliminating thermal expansion difference.

SUMMARY OF THE INVENTION

It is an object of the present invention is to provide a compensation assembly associated to a damper for a gas turbine that may compensate relative rotation generated between the combustor chamber and the damper, in particular, the resonator cavity of the damper, due to thermal expansion difference.

This object is obtained by a compensation assembly for a damper of a combustion chamber of a gas turbine, the damper comprising a resonator cavity with a neck tube in flow communication with the interior of the combustion chamber, wherein the compensation assembly comprises a spherical joint associated to the neck tube and configured to allow relative rotation between the combustion chamber and the resonator cavity, and wherein the spherical joint comprises a bulb portion disposed around the neck tube and a spherical socket disposed around the neck tube and adapted to internally host the bulb portion, wherein the spherical socket is formed by a top collar portion and a bottom collar portion connected to each other.

According to a preferred aspect of the invention, the bulb portion is a collar element inserted on the neck tube. According to a further preferred aspect, the collar element is internally shaped such to allow a relative radial displacement of the neck tube.

According to a further preferred aspect of the invention, the collar element defines internally a cylindrical surface.

According to a further preferred aspect of the invention, the bottom and top collar portions are connected by a thread.

According to a further preferred aspect of the invention, the compensation assembly further comprises a sliding part formed on the spherical socket adapted to be air-tightly fitted into a groove of the resonator cavity such to provide relative slide in a direction traversing a longitudinal axis of the neck tube between the sliding part and the groove.

According to a further preferred aspect of the invention, the sliding part is formed on said top collar portion.

It is a further object of the present invention to provide an insert element for a damper of a combustion chamber of a gas turbine, comprising a connecting portion adapted to secure the insert element to a carrier structure of the combustion chamber; a through hole for admitting a neck tube of the damper; and a base slopped portion.

BRIEF DESCRIPTION OF THE DRAWINGS

The objects, advantages and other features of the present invention will become more apparent upon reading of the following non-restrictive description of preferred embodiments thereof, given for the purpose of exemplification only, with reference to the accompany drawing, through which similar reference numerals may be used to refer to similar elements, and in which:

FIGS. 4 and 5 show a comparison between the mounting of the compensation assembly according to the prior art (left) and the mounting of the compensation assembly according to the present invention (right) on the neck tube;

DETAILED DESCRIPTION OF THE INVENTION

Figure 1:
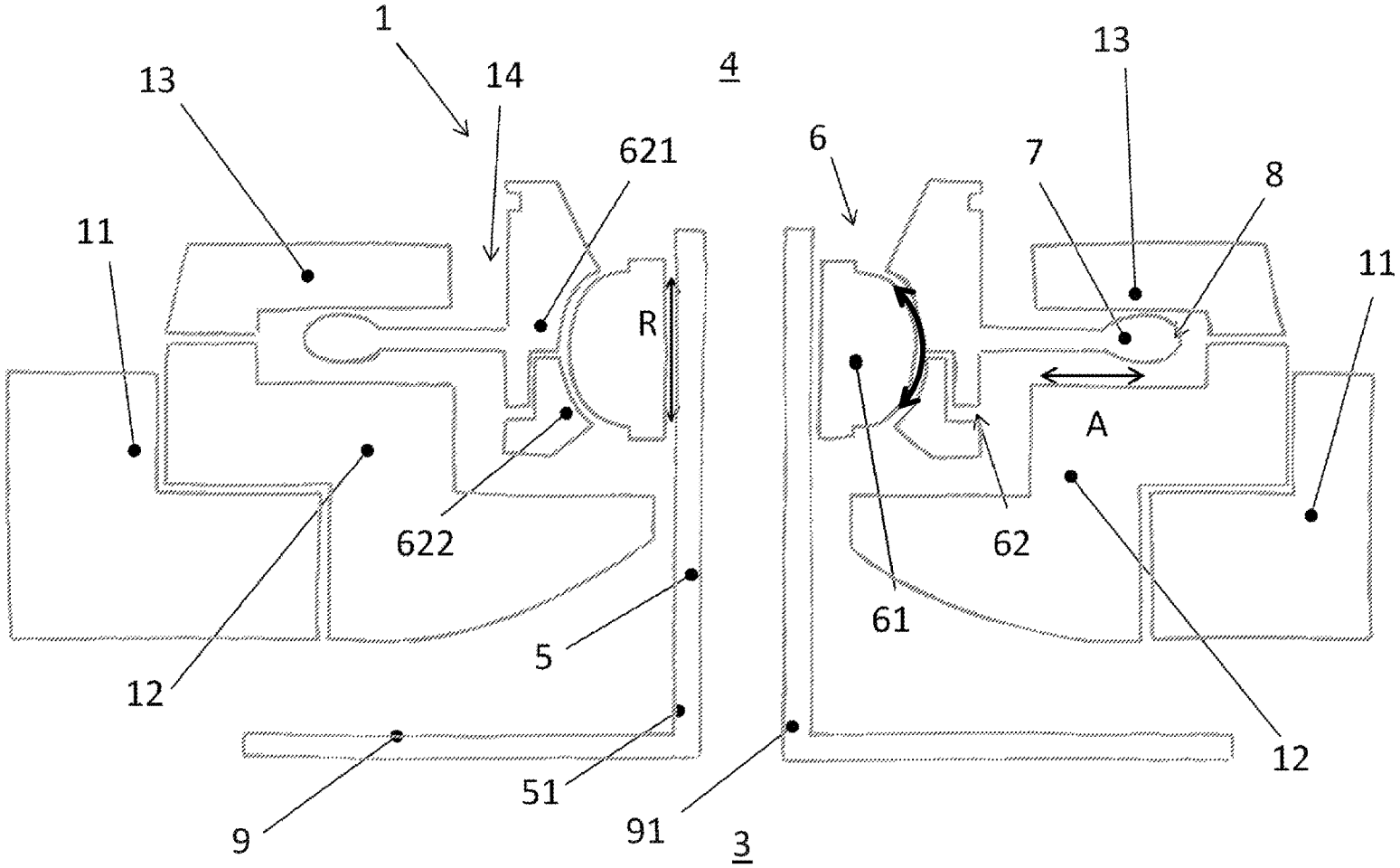
FIG. 1 shows a schematic sectional view of a compensation assembly according to the present invention.

With reference to FIG. 1, it is shown a schematic cross sectional view of a compensation assembly according the present invention, generally denoted with numeral reference 1. The compensation assembly 1 is associated to a damper of a combustion chamber 3. The damper comprises a resonator cavity 4 with a box or cylinder shape as delimitated by a peripheral wall 13 and an inlet 14. As shown in FIG. 1, the major part of the resonator cavity 4 is cut away as this would not prevent full and complete understanding of the technical solutions of the present invention. Also, only parts of the combustion chamber 3 closely related to the present invention is shown in FIG. 1 for clarity and simplicity. The resonator cavity 4 is air tightly attached to a carrier structure 11 of a combustion chamber 3 by fasteners, not shown in FIG. 1. In an example implementation of the present invention, the carrier structure 11 of the combustion chamber 3 may be a casing of the combustion chamber 3. Those skilled in the art should appreciate that the carrier structure 11 provides a carrier for the resonator cavity 4, and should not be limited to the casing of the combustion chamber as described herein. In addition, the damper comprises a neck tube 5 that is in flow communication with the resonator cavity 4 through the compensation assembly 1 according to the present invention in order to compensate relative movement between the resonator cavity 4 and the combustion chamber 3.

The neck tube 5 is air tightly attached at a first end 91 thereof to a wall portion 9, or segment, of the combustion chamber 3. For example, a first end 51 of the neck tube 4 may be welded to the segment 9 of the combustion chamber 3. The compensation assembly 1 comprises a spherical joint, generally denoted with 6, associated to the neck tube 5 and configured to allow a relative rotation between the combustion chamber 3 and the resonator cavity 4. In particular, the spherical joint 6 comprises a bulb portion 61 which is disposed around the neck tube 5 and a spherical socket 62 which, in turn, is internally adapted to host the bulb portion 61 such to permit relative rotation between resonator cavity 4 and combustion chamber 3. More in particular, spherical socket 62 is formed by a top collar portion 621 and a bottom collar portion 622 connected to each other.

According to a preferred embodiment of the invention, the bulb portion 61 is also a collar element 61 which is inserted on the neck tube 5 and comprises an external rounded portion which is movable within the spherical socket 62.

Advantageously, the collar element 61 is internally shaped such to permit a relative radial displacement as indicated by arrow R in the drawing. Preferably, the collar element 61 internally defines a cylindrical surface, where the neck tube 5 is accommodated and can slide radially to compensate in such direction possible radial thermal expansions. Furthermore, in order to provide the resonator cavity 4 with means adapted to compensate possible thermal axial expansions along a direction traversing a longitudinal axis of the neck tube 5, indicated in the figure by arrows A, compensation assembly 1 comprises a sliding part 7 formed on the spherical socket 62 and adapted to be air-tightly fitted within a groove 8 of the resonator cavity 4. Preferably, sliding part 7 is formed on the top collar portion 621 of the spherical socket 62.

Figure 2:
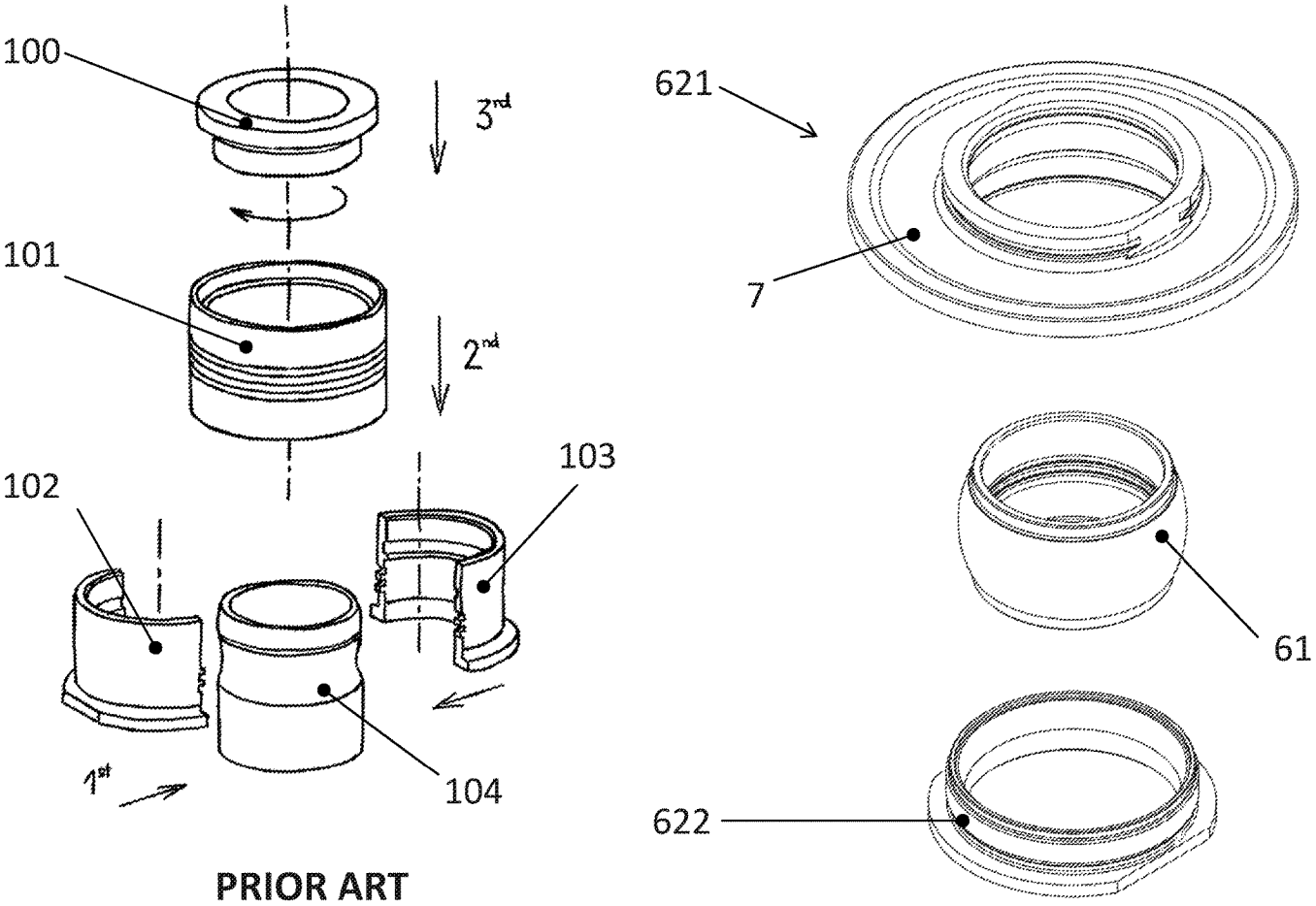
FIG. 2 shows a comparison of exploded views of a compensation assembly according to the prior art (left) and the compensation assembly according to the present invention (right)

With reference to next FIG. 2, it is showed a comparison between exploded views of a compensation assembly according to the prior art (left) vs the compensation assembly according to the present invention (right).

The compensation assembly according to the prior art comprises two half-collar portions 102 and 103 which are connected along the longitudinal direction of a neck tube 104. A bulb portion is integrally formed on the neck tube 104, which is hosted into a correspondent internal spherical socket formed by the half-collar portions 102 and 103 after their connection, which is effected by a third top junction element 100 and an annular portion 101. Differently and advantageously, the compensation assembly according to the invention involves a reduction of number of parts to be assembled as well as the avoidance of a bulb portion integrally formed on a portion of the external surface of the neck tube 104. In fact, the bulb portion 61 is now enclosed within the two collar portions 621 and 622 connected along a direction which is transversal with respect to the longitudinal axis of the neck tube. Preferably, the two top and bottom collars 621 and 622 are connected by means of complementary threaded portions. Additionally, the bulb portion 61 is yet a collar element internally cylindrically shaped such to accommodate the neck tube (not pictured) and allow relative radial displacement. Differently, according to the prior art, the annular portion 101 is also hosted into a yet another external collar (not shown) to provide radial displacement. Such external collar comprises sliding parts. According to the invention, the sliding parts 7 are advantageously formed on the top collar portion 621 of the spherical socket 62.

Figure 3:
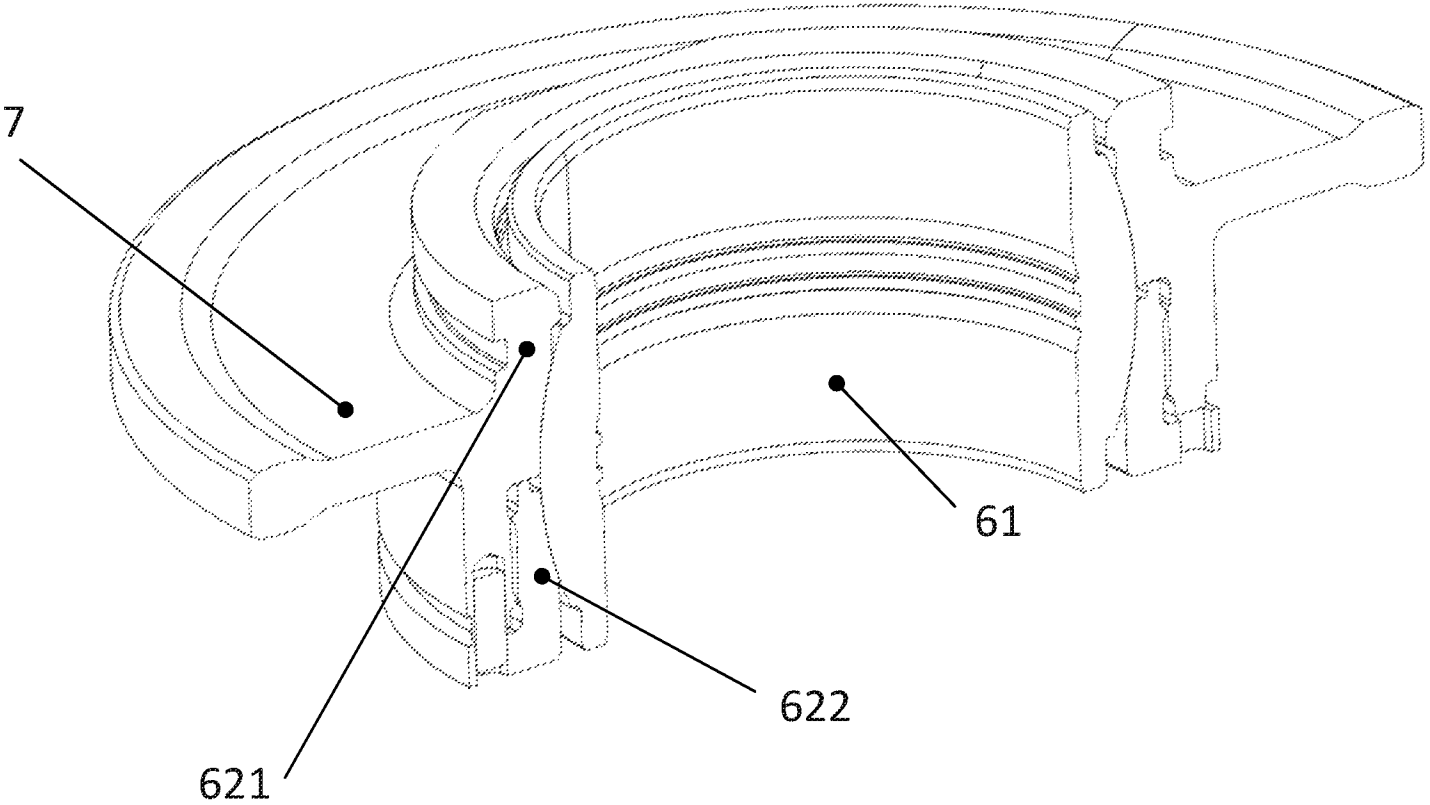
FIG. 3 shows a cross-sectional view of the compensation assembly according to the present invention.

Making now reference to following FIG. 3, it is shown a cross sectional view of the compensation assembly according to the present invention. In particular, it is clearly shown the bulb portion of the collar element 61 which is hosted into a correspondent spherical socket formed by the connection of the top and bottom collar portions 621 and 622 by means of a thread.

Figure 5:
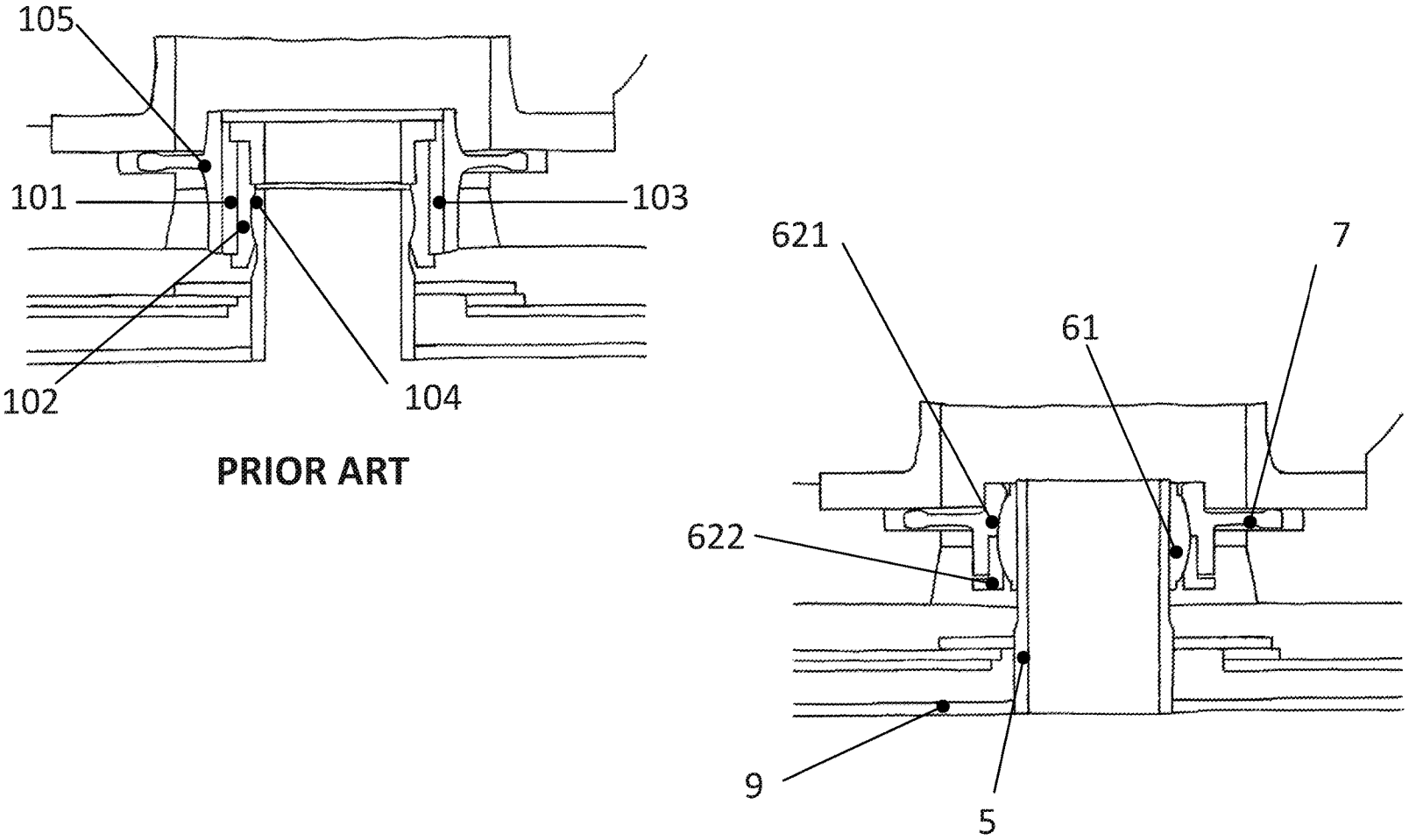

FIGS. 4 and 5 show the insertion of the compensation assembly into the neck tube according to the prior art (left) and according to the present invention (right). According to the known art, the neck tube presents an external bulb-shaped portion 104 which is adjusted inside a spherical socket formed by connection of half-collar elements 102 and 103 which are secured via the third top junction element 100 and the annular portion 101. To provide radial displacement, the assembly thus formed is yet lodged into the now visible external collar 105, provided with sliding parts for enabling radial displacement. The compensation assembly according to the present invention, conversely, is provided by the connection of a less number of components, that is the collar element 61 disposed around the neck tube 5 providing radial displacement and the spherical socket formed by connection of top and bottom collar elements 621 and 622. The spherical socket provides also means for compensating axial displacement, as sliding part 7 is formed directly on the top collar portion 621.

It will then be appreciated that the new compensation assembly, compared to the known art, facilitates the assembly procedure in the factory, improves the sourcing of the different parts as well as facilitating the machining of the different components. As the number of components is reduced, this advantageously affects the costs involved. Furthermore, the assembly according to the prior art needed to be assembled to the segment prior to the installation in the gas turbine. The innovative design can be assembled independent from the segment. It may be installed during the assembly of the gas turbine.

It will also be appreciated that separating the assembly of the segment and the spherical joint improves the sourcing. The assembly according to the invention may be ordered at a different supplier and directly delivered to the gas turbine assembly site. The spherical joint of the assembly according to the invention may be manufactured by turning operation, whilst the assembly according to the prior art requires turning operations as well as EDM (Electric Discharge Machining). In particular, EDM is generally used for the half collar elements 102 and 103 which is an expensive cutting operation. Separating the assembly of the segment and the spherical joint also allows the sourcing of both parts at the most cost-effective place. By reducing the manufacturing steps costs can be saved.

Figure 6:
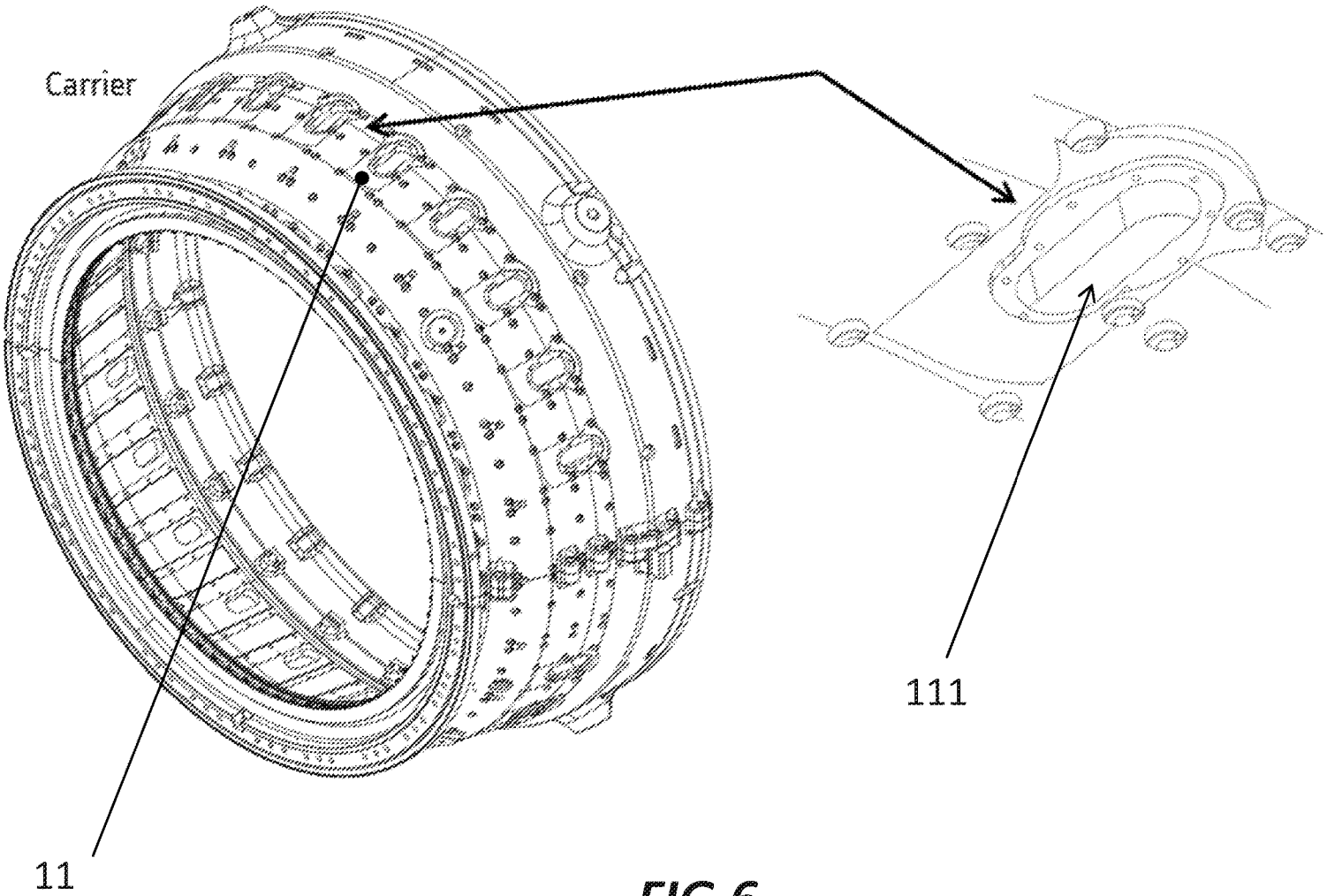
FIG. 6 shows an annular portion of a carrier structure of a combustion chamber.

FIG. 6 shows the carrier structure 11 in a perspective view. In order to enable the installation of the segment with the protruding neck into the carrier structure 11 it is advisable to have a sufficient wide opening. For this reason, an elongated opening 111 is advantageously provided in the carrier structure 11, where the neck tube is inserted (not shown). In order to close an open gap formed between the opening 111 in the carrier 11 and the neck tube, an insert element (not shown in the figure) is introduced and connected to the carrier structure 11 at the interface between the protruding neck tube (not shown) and the carrier structure 11, in correspondence of the elongated opening 111.

Figure 7:
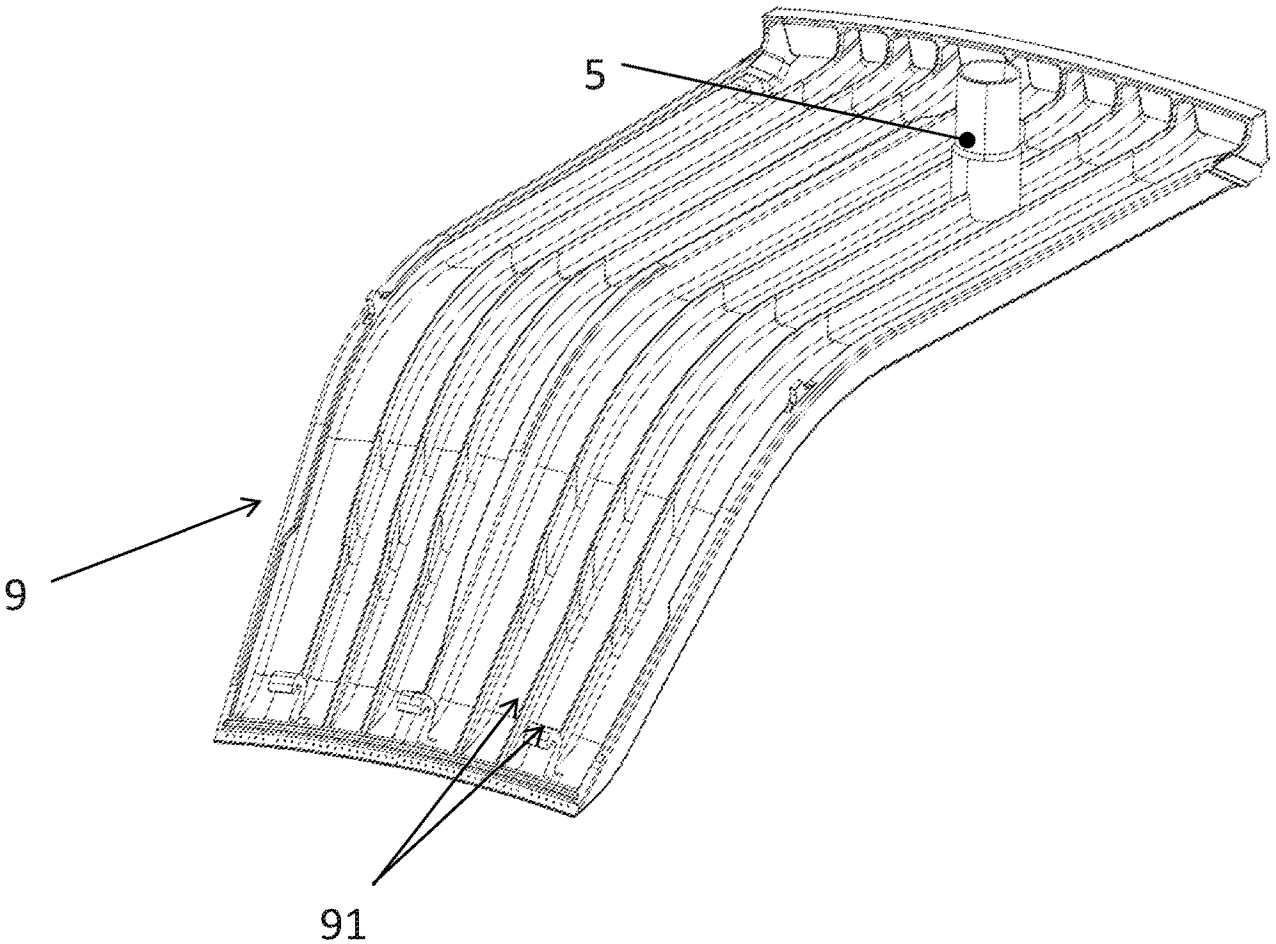
FIG. 7 shows a perspective view of a segment where a neck tube is mounted.

Next FIG. 7 shows a perspective view of the segment 9, having cooling channels 91 formed on its surface, on which the protruding neck tube 5 of the resonator cavity is attached. As clearly visible in the figure, by implementing a neck tube into the segment 9, the cross section area of the cooling channels adjacent thereto reduces significantly. This leads to a reduction of cooling air flow, which results in an increased temperature of the component. It has been proven that it is not sufficient to increase the cross section area of the cooling channels by removing the ribs. There are not enough ribs to compensate for the neck blockage and also the ribs are necessarily required for the mechanical integrity of the segment. Advantageously, the insert element is introduced between the neck tube 5 and the elongated hole located on the carrier structure to address such technical problem.

Figure 8:
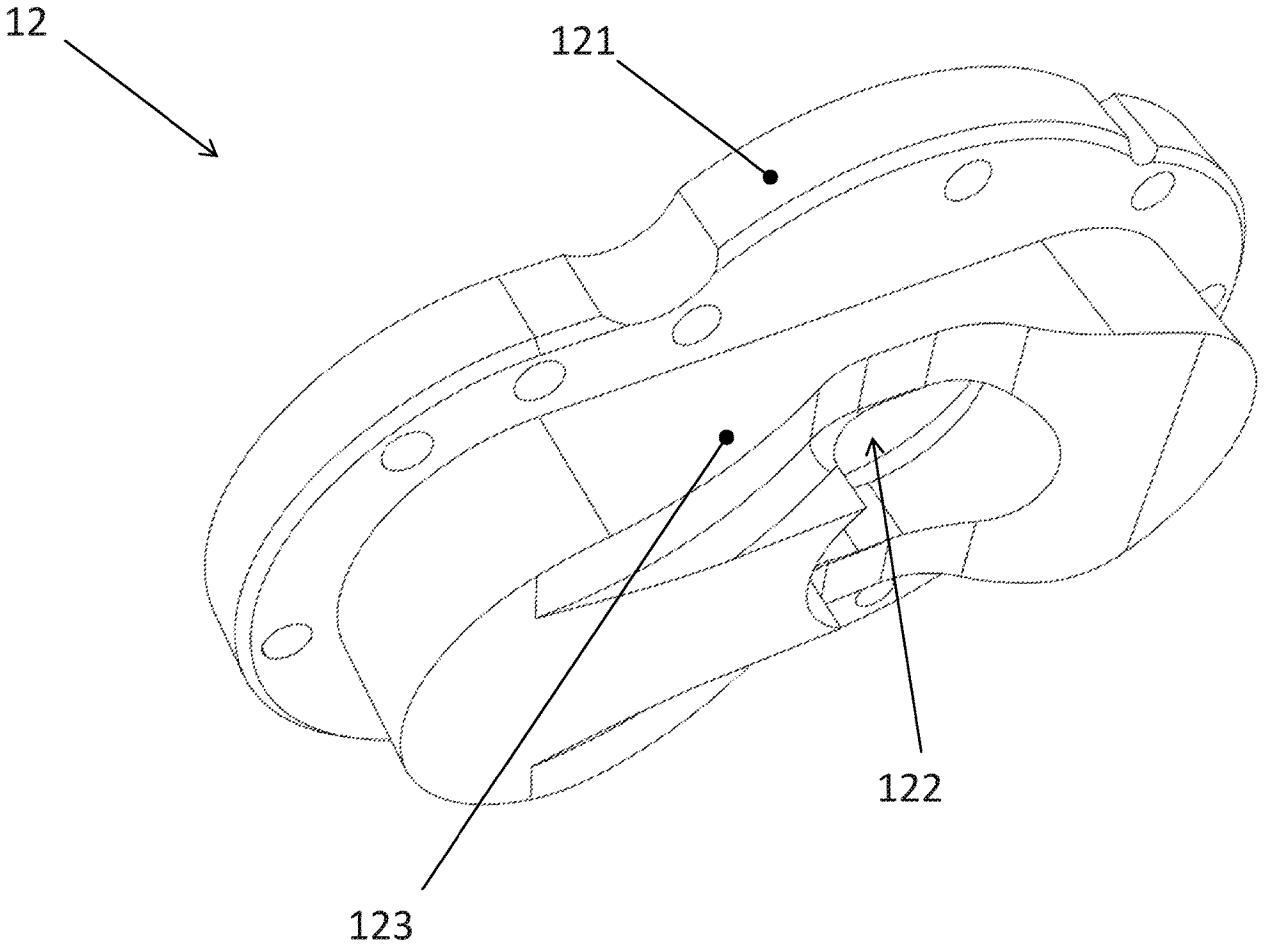
FIG. 8 shows a perspective view of an insert element according to the present invention.

The insert element is shown in a perspective view in following FIG. 8, and generally denoted with the numeral reference 12. In particular, the insert element 12 comprises a connecting portion 121 adapted to secure the insert element 12 to the carrier structure (not shown), a through hole 122 for admitting the neck tube and a base slopped portion 123. Advantageously, the base slopped portion 123 is such to increase the height of the cooling channel, in order to compensate for the blockage due to the presence of the neck tube, thus providing a wider channel for the cooling fluid. More in particular, the insert is positioned in such a way that it facilitates the increase of the cooling channel height. The increase of the cooling channel height is aerodynamically formed to avoid unnecessary pressure losses therein.

Figure 9:
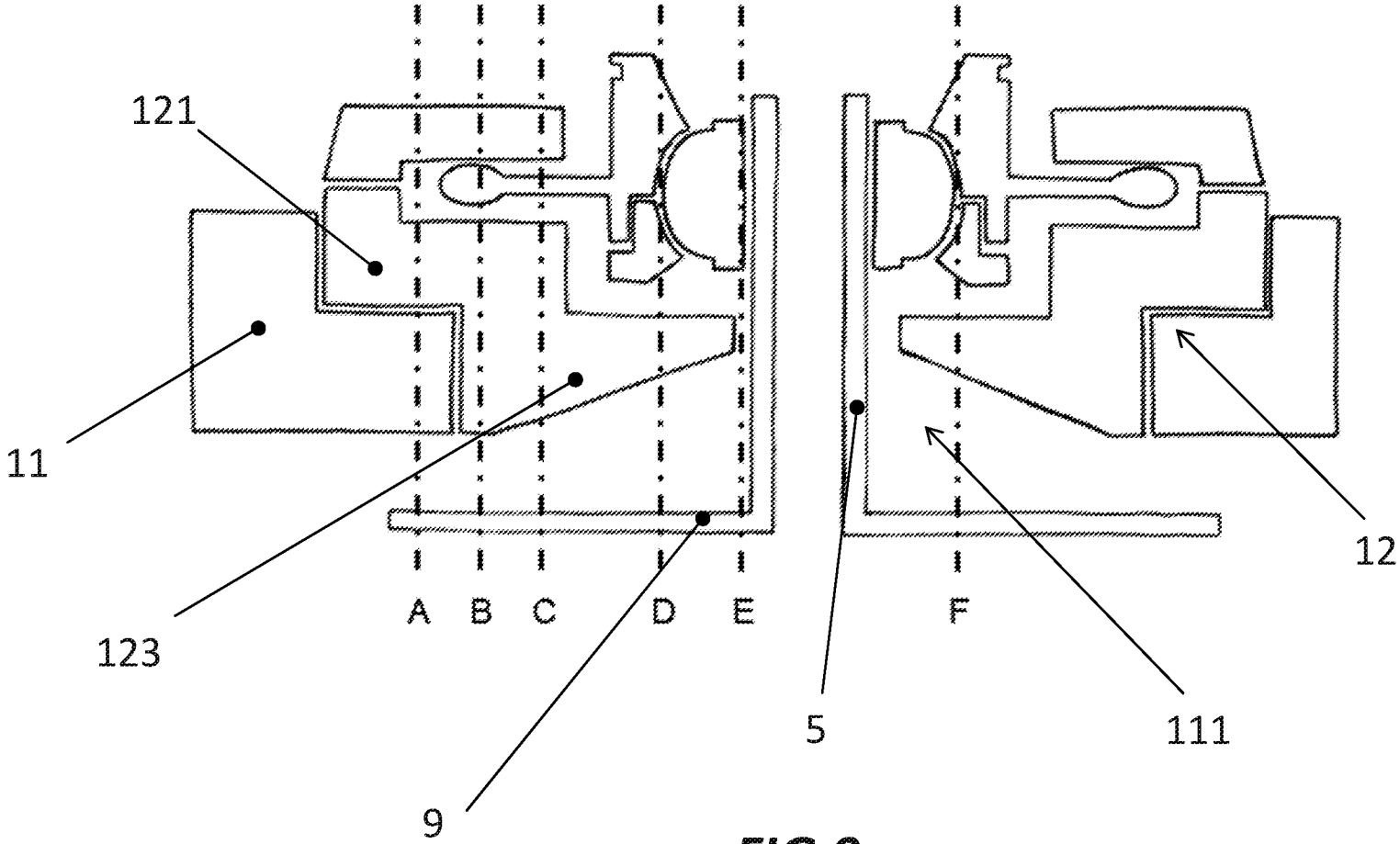
FIGS. 9 and 10 show subsequent section/frontal views of the segment where the neck tube and the insert element are mounted.
Figure 10:
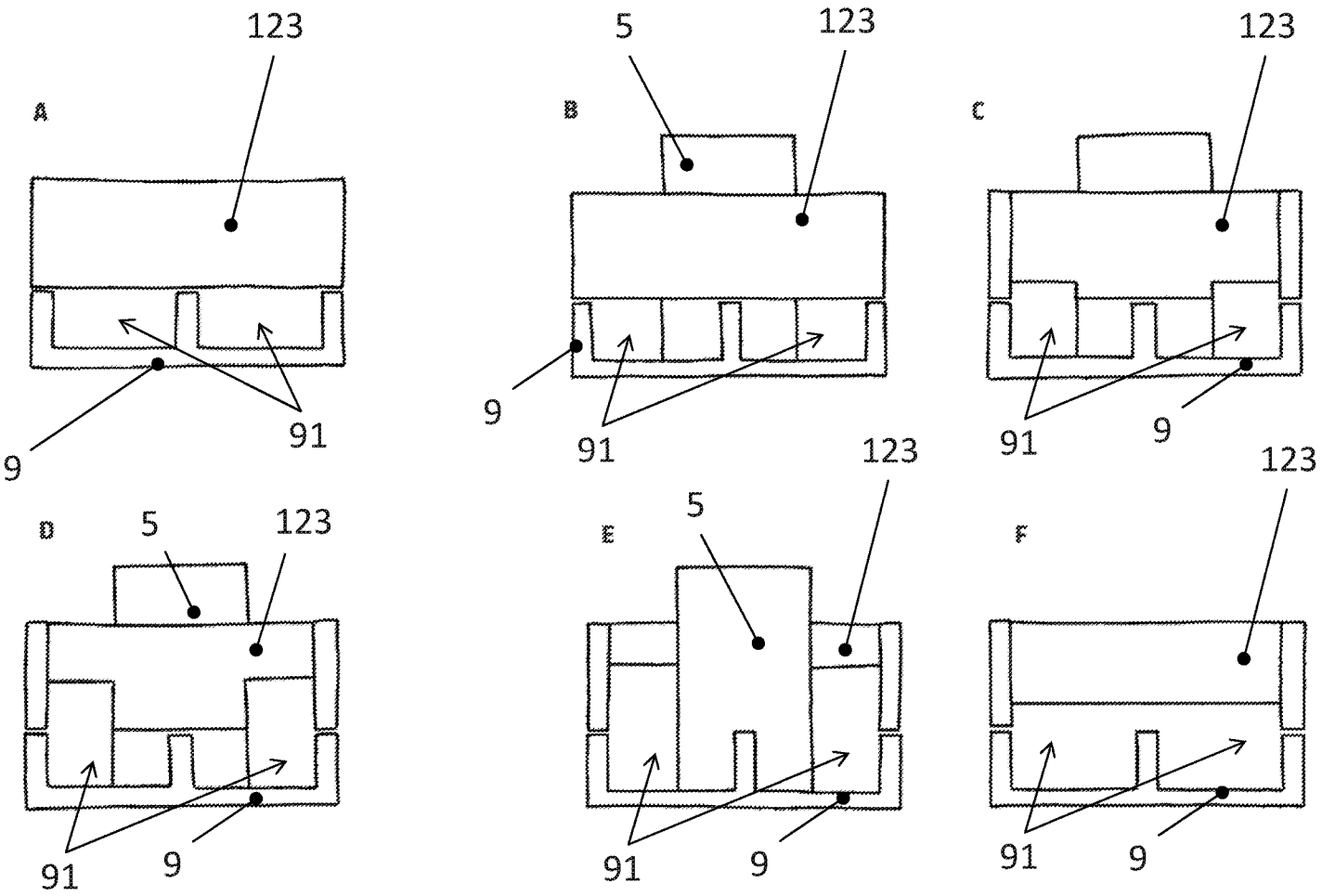

This is better explained and illustrated with reference to last FIGS. 9 and 10, taken in combination. FIG. 9 shows the schematic sectional view of the neck tube 5 protruding from the segment 9 through the elongated opening 111, wherein the opening 111 is closed by the insert element 12, comprising the connecting portion 121 securing the insert 12 to the carrier structure 11 and the slopped portion 123. In the drawings subsequent section lines A-F are indicated, and correspondent frontal views of the segment 9 are depicted in FIG. 10. It is in fact shown how, advancing along the cooling channels 91 of the segment 9, the slopped portion 123 provides a compensation for the reduction of the cooling channels 91 due to the presence of neck tube 5. In fact, in correspondence of sections C-F the slopped portion 123, decreasing the extent of its section, increases the height of the channels 91 providing such compensation.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A compensation assembly for a damper of a combustion chamber of a gas turbine, the damper having a resonator cavity with a neck tube in flow communication with an interior of the combustion chamber, the compensation assembly comprising:

a spherical joint associated to a neck tube and configured to allow relative rotation between a combustion chamber and a resonator cavity, the spherical joint including:

a bulb portion configured as a collar element for disposal around the neck tube;

a spherical socket configured to internally host said bulb portion, wherein the spherical socket has a top collar portion and a bottom collar portion, the top and bottom collar portions being connected to each other by a joint; and a sliding part formed directly on the spherical socket and configured to be air-tightly fitted into a groove of the resonator cavity in a direction traversing a longitudinal axis of the neck tube between said sliding part and the groove, wherein said collar element is internally shaped for relative radial displacement of the neck tube along the longitudinal axis of the neck tube.

2. The compensation assembly according to claim 1, in combination with a damper having the resonator cavity with the neck tube, wherein said bulb portion is inserted on the neck tube.

3. The compensation assembly according to claim 2, wherein said collar element defines internally a cylindrical surface.

4. The compensation assembly according to claim 1, wherein said bottom and top collar portions are connected by complementary threaded portions as the joint.

5. The compensation assembly according to claim 1, wherein said sliding part is formed directly on said top collar portion.

* * * * *